US005577728A

United States Patent [19]

Kondo

[11] Patent Number: 5,577,728

[45] Date of Patent: Nov. 26, 1996

[54] JIGSAW PUZZLE

[75] Inventor: Hiroshi Kondo, Tokyo, Japan

[73] Assignee: Tenyo Co., Ltd., Tokyo, Japan

[21] Appl. No.: 445,348

[22] Filed: May 19, 1995

[30] Foreign Application Priority Data

Aug. 9, 1994 [JP] Japan ..... 6-187142
Oct. 7, 1994 [JP] Japan ..... 6-244032

[51] Int. Cl.[6] ..... A63F 9/12

[52] U.S. Cl. ..... 273/157 A; 273/157 R

[58] Field of Search ..... 273/153 R, 157 R, 273/157 A, 155; 40/157, 152, 158.1

[56] References Cited

U.S. PATENT DOCUMENTS

| | | | |
|---|---|---|---|
| 2,151,055 | 3/1939 | Stark | 273/157 A |
| 3,046,686 | 7/1962 | Fogle | 273/157 A |
| 3,682,479 | 8/1972 | Miller et al. | 273/157 R |
| 4,257,606 | 3/1981 | Launzel | 273/157 R |
| 4,815,742 | 3/1989 | Augustine | 273/157 A |
| 5,203,847 | 4/1993 | Butt | 273/157 R |

FOREIGN PATENT DOCUMENTS

| | | | |
|---|---|---|---|
| 621701 | 4/1949 | United Kingdom | 273/157 A |
| 2249484 | 5/1992 | United Kingdom | 273/157 R |

*Primary Examiner*—Steven B. Wong
*Attorney, Agent, or Firm*—Sixbey, Friedman, Leedom & Ferguson, P.C.; Gerald J. Ferguson, Jr.; Tim L. Brackett

[57] ABSTRACT

The jigsaw puzzle according to the present invention comprises a substrate and transparent member. The substrate has a painting, photograph or pattern provided on at least the first side thereof and is cut into a multiple of irregular, interlocking pieces. The transparent member has marked thereon a figure which is to conceal at least a part of the cut lines in the substrate, and is to be disposed on the first side of the substrate. Since the zigzag cut lines in the substrate are concealed by the figure marked on the transparent member, the jigsaw puzzle having the picture thus reproduced can be an improved interior decoration.

16 Claims, 8 Drawing Sheets

JIGSAW PUZZLE

BACKGROUND OF THE INVENTION a) Field of the Invention

The present invention relates to a jigsaw puzzle having a painting, photograph, pattern or the like prodded on at least the first side of a substrate which is cut into a multiple of irregular, interlocking pieces, and more particularly to a jigsaw puzzle of which the zigzag cut lines in the substrate are concealed by files prodded on a transparent sheet to enhance the effect of the jigsaw puzzle as an interior decoration.

b) Prior Art

Generally, a jigsaw puzzle has a painting, photograph, pattern or the like prodded on at least the first side (front side) of a substrate which is cut into a multiple of irregular, interlocking pieces. To solve this puzzle, one must assemble the multiple of irregular, interlocking pieces to form the original painting, photograph, pattern or the like on the substrate.

The jigsaw puzzle is a plaything to reproduce a painting, photograph, pattern or the like on a substrate and can also have the reproduced picture set in a holder such as a frame for use as an interior decoration.

The conventional jigsaw puzzle has a substrate cut into a multiple of irregular, interlocking pieces, so zigzag cutting lines will be seen in the substrate.

SUMMARY OF THE INVENTION

The present invention has an object to provide a jigsaw puzzle of which the zigzag cut lines in the substrate are concealed by things formed on a transparent sheet to enhance the effect of the jigsaw puzzle as an interior decoration.

The jigsaw puzzle according to the present invention comprises a substrate and a transparent sheet. The substrate has marked thereon or on at least the first side thereof a painting, photograph, pattern or the like, and is cut into a multiple of irregular, interlocking pieces. The transparent sheet has provided thereon things destined to conceal at least a part of the cut lines in the substrate, and is laid on the first side of the substrate.

Thus, the jigsaw puzzle according to the present invention has an improved decorative effect since the zigzag cut lines in the substrate are concealed by the figures provided on the transparent sheet.

In order that the invention may be clearly understood and readily carried into effect, four preferred embodiments thereof will now be described with reference to the accompanying drawings.

DETAILED DESCRIPTION OF THE PREFERRED EMBODIMENTS

Figure 1:
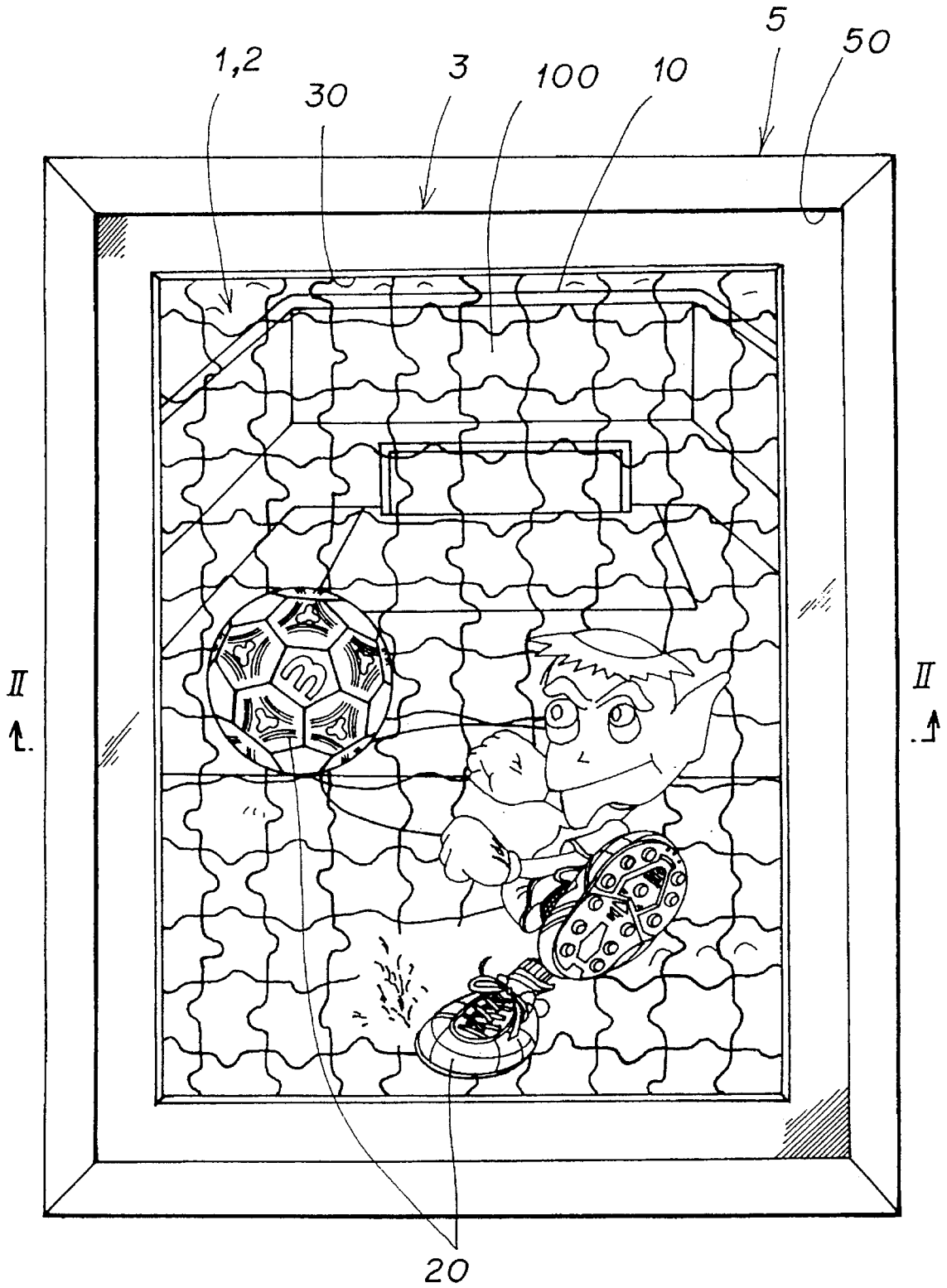
FIG. 1 is a front view of a first embodiment of the jigsaw puzzle according to the present invention, showing the reassembled substrate, transparent sheet, etc. held in a frame.

FIGS. 1 to 6 show together the first embodiment of the jigsaw puzzle according to the present invention.

The first embodiment of the jigsaw puzzle comprises a substrate generally indicated with a reference numeral 1. The substrate 1 is a flat sheet such as a cardboard as shown in FIGS. 1 to 4. The substrate 1 has a painting, photograph, pattern or the like 10 provided on at least the first side (front) thereof by printing. In this embodiment, the painting, photograph or pattern 10 is a soccer ground, for example.

The substrate 1 is cut into a multiple of irregular, interlocking pieces 100.

Each of the pieces 100 in the substrate 1 has concave portions 101 and convex portions 102. To reproduce the picture 10, the pieces 100 are assembled together by fitting them to one another at the convex portions 102 thereof into the concave portions 101. The jigsaw puzzle according to the present invention is enjoyable in reproducing the picture 10 of the soccer ground marked on the substrate 1. Note that the assembling of the pieces 100 for reproduction of the picture 10 is to be done on a back plate 4 having a background scene or any other flat surface which will be described later.

Figure 2:
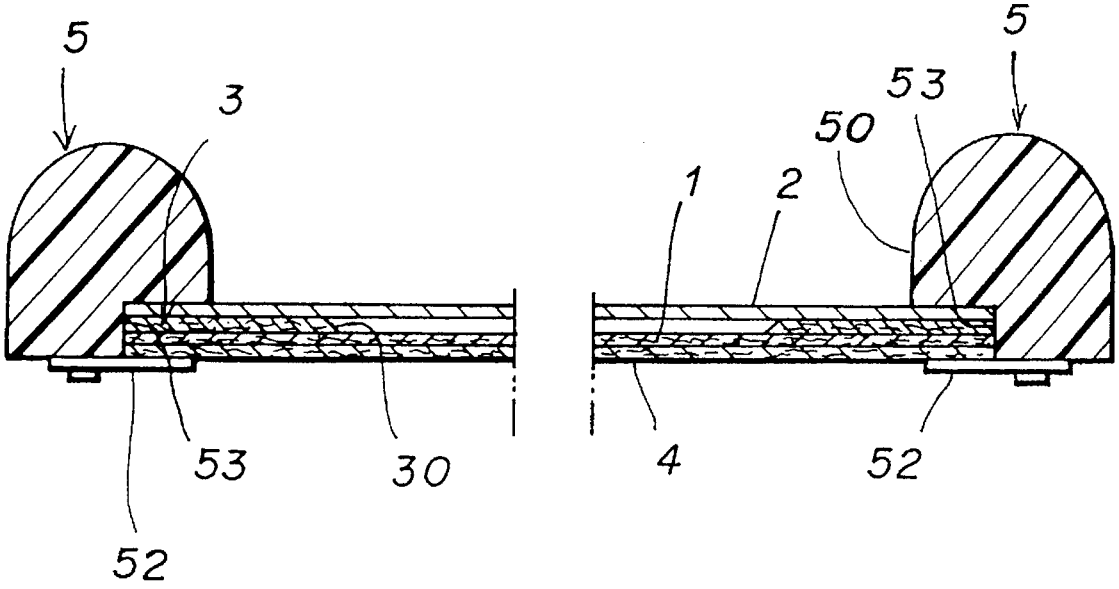
FIG. 2 is a sectional view taken along the line II—II in FIG. 1.
Figure 3:
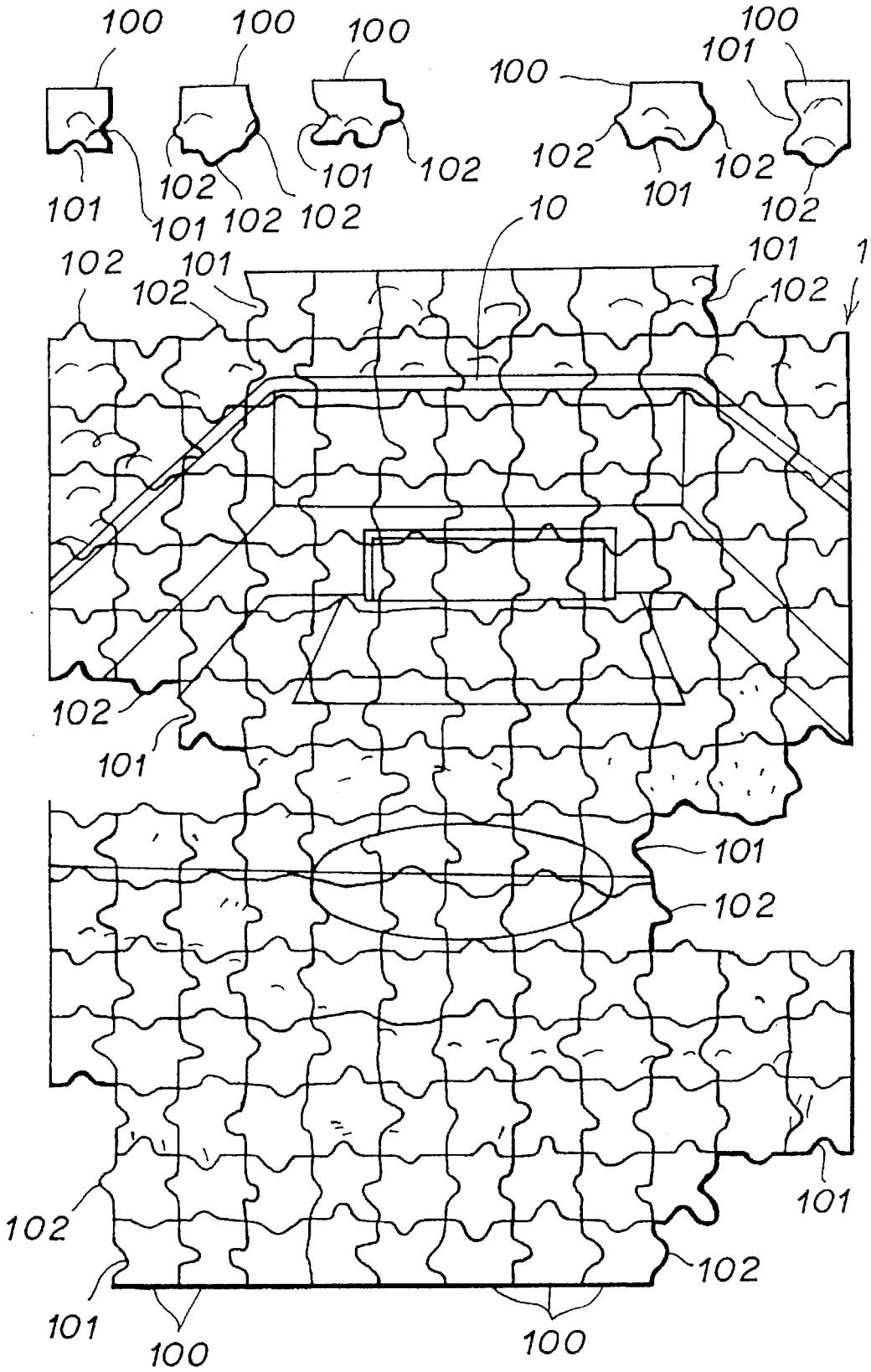
FIG. 3 is a front view of the substrate being assembled.
Figure 4:
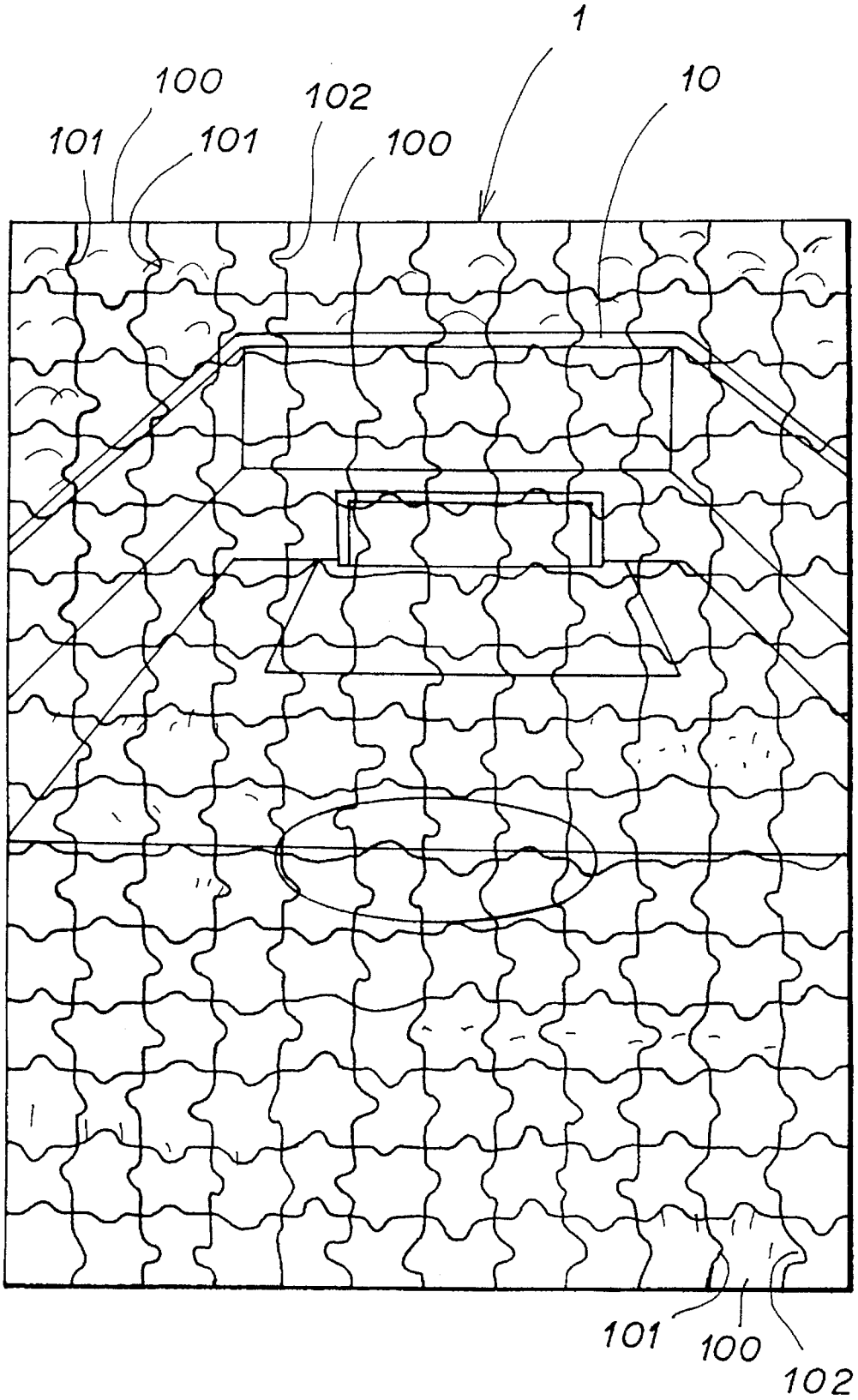
FIG. 4 is a front view of the assembled substrate.
Figure 5:
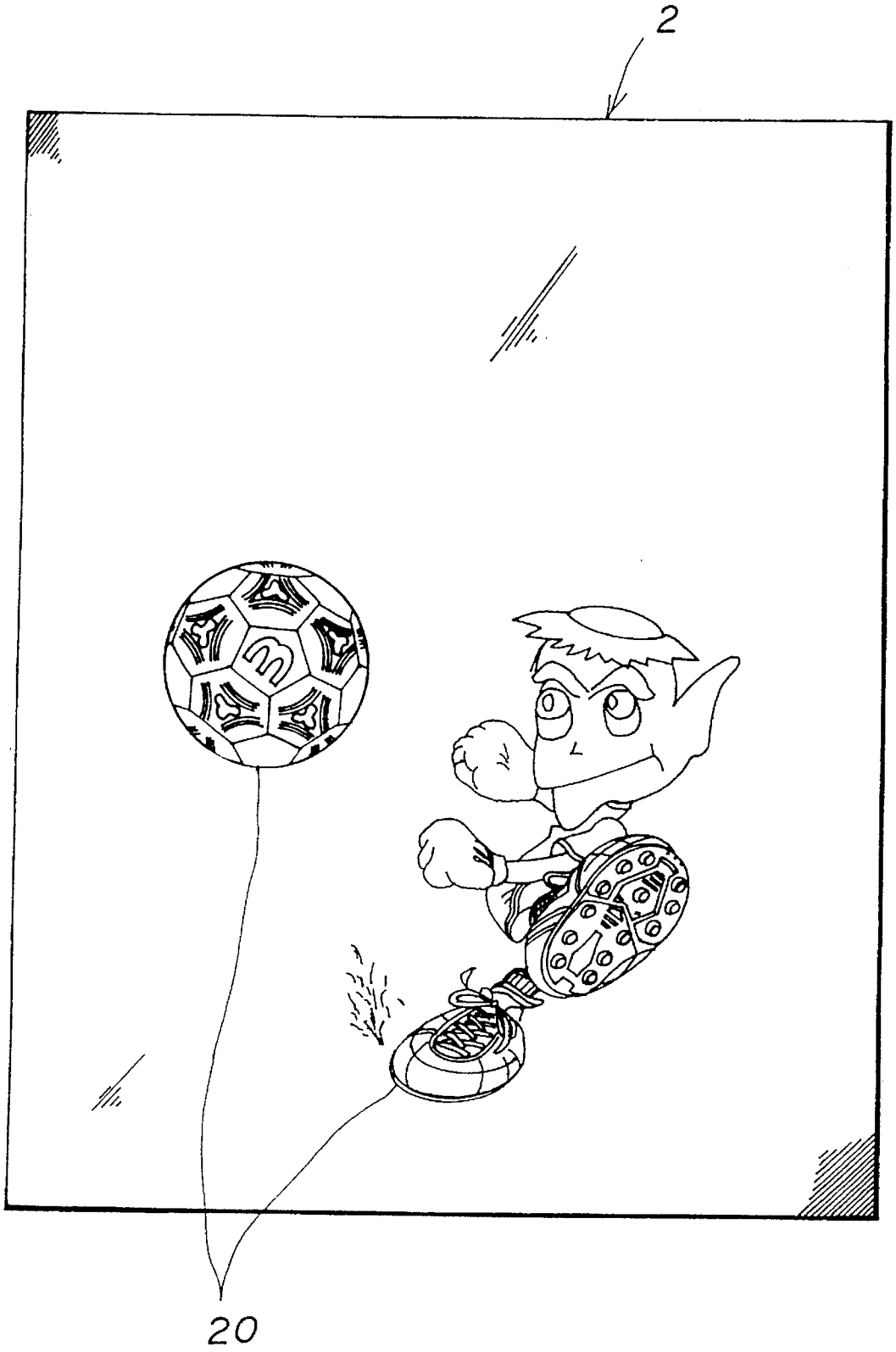
FIG. 5 is a front view of the transparent sheet.

The substrate 1 has a transparent member 2 disposed on the surface thereof. The transparent member 2 is raised by means of an intermediate member 3 from the surface of the substrate 1. The transparent member 2 is a transparent sheet (a soft plastic of 0.25 mm or more in thickness) or a transparent film (a plastic of 0.25 mm or less in thickness), made of a polyvinyl chloride, for example, as shown in FIGS. 1 and 2. The transparent member 2 has a FIG. 20 provided thereon by printing, for example. The figure in this embodiment is a soccer player kicking a soccer ball.

Figure 6:
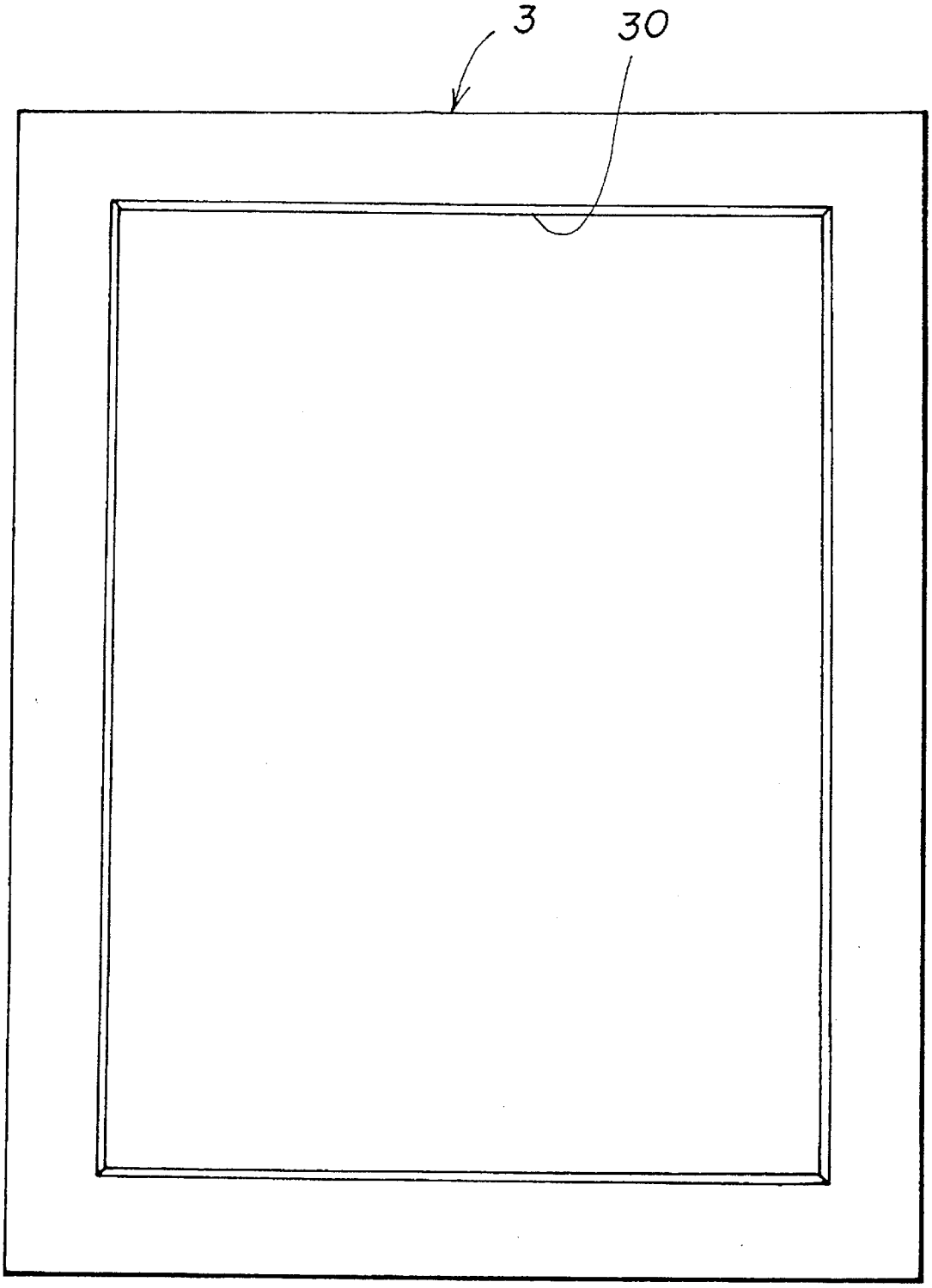
FIG. 6 is a front view of an intermediate member.

An intermediate member 3 is provided between the transparent member 2 and substrate 1. The intermediate member 3 is made of a cardboard, for example, as shown in FIGS. 1, 2 and 6. It is shaped like a frame having an opening 30 formed in the center thereof. The intermediate member 3 is nearly the same in outside dimensions as the substrate 1. The outside dimensions of the opening 30 of the intermediate member 3 are slightly smaller than the dimensions of an opening 50 of a frame 5 which will be further described later, so that the intermediate member 3 partially overlaps the frame 5.

The substrate 1 has provided at the second (rear) side thereof the back plate 4 made of a cardboard, for example. The back plate 4 has nearly same dimensions as the substrate 1.

The above-mentioned substrate 1, transparent member 2, intermediate member 3 and back plate 4 are held by the frame 5. The frame 5 is made of a resin (or a wood or metal)

and has the opening 50 formed in the center thereof as shown in FIGS. 1 and 2. The frame 5 has a plurality of retainers 52 provided at the back thereof. Also the frame 5 has an engagement recess 53 formed in the back thereof along the inner circumference thereof as shown in FIG. 1.

The substrate 1 reproduced from the pieces 100, the transparent member 2, intermediate member 3 and back plate 4 are assembled together, fitted wholly in the recess 53 in the frame 5, and retained in the frame 5 with the retainers 52 closed inwardly.

The jigsaw puzzle according to the present invention thus comprises the substrate 1 carrying thereon a painting, photograph or pattern of a soccer ground 10 and on which the transparent member 2 having marked thereon a character or FIG. 20 who is a soccer player kicking a soccer ball. As shown in FIG. 1, the zigzag cut lines in the substrate 1 are concealed by the FIG. 20 on the transparent member 2 to emphasize the soccer player 20 and thus enhance the effect of the jigsaw puzzle as an interior decoration.

Especially in this embodiment, the transparent member 2 is disposed on the substrate 1 with the intermediate member 3 placed between them, so the transparent member 2 is off the surface of the substrate 1. The soccer player 20 on the transparent member 2 will appear as edge-enhanced.

It should be noted that the transparent member 2 may be laid directly on the surface of the substrate 1 with the intermediate member 3 not used. Also, the transparent member 2 may be disposed off the surface of the substrate 1 by using small projections, pins or the like, not the intermediate member 3.

In the aforementioned embodiment, one transparent member 2 is disposed on the surface of the substrate 1. However, multiple transparent members may be laid on the surface of the substrate 1. For instance, a goal keeper (not shown) may be marked on one of the transparent members, and any other soccer player (not shown) be marked on the other transparent members. These transparent members may be laid on the one carrying the soccer player 20 kicking the ball and which is disposed on the surface of the substrate 1.

The transparent member 2 used in the above embodiment is made of a polyvinyl chloride transparent sheet or film. However, it may be made of an acrylic transparent sheet (a plastic of 0.25 mm or more in thickness) such as polyacrylate ester, polymethacrylate ester, polymethacrylate methyl or the like and have a marking printed thereon.

The assembly of the substrate 1 reproduced from the pieces 100, transparent member 2, intermediate member 3 and back plate 4 may be held in any frame other than the frame 5.

The aforementioned embodiment uses the back plate 4, but the back plate 4 may be omitted.

The substrate 1 completely reproduced from the pieces 100 may be applied with an adhesive to prevent the pieces 100 from being separated from one another.

Figure 7:
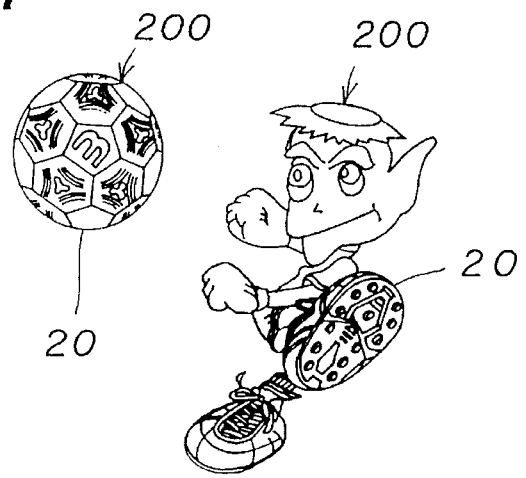
FIG. 7 is a front view of a transparent sheet used in a second embodiment of the jigsaw puzzle according to the present invention.

FIG. 7 is a front view of the transparent member used in the second embodiment of the jigsaw puzzle according to the present invention.

In this embodiment, the transparent member 200 is a portion 20 cut from on a transparent PVC sheet or film. The portion 20 carries a soccer player and ball printed on a transparent sheet.

The FIG. 20 on the transparent member 200 can be laid in a selected position on the surface of the jigsaw puzzle substrate 1 to increase the variation in layout of the transparent member 200.

Figure 8:
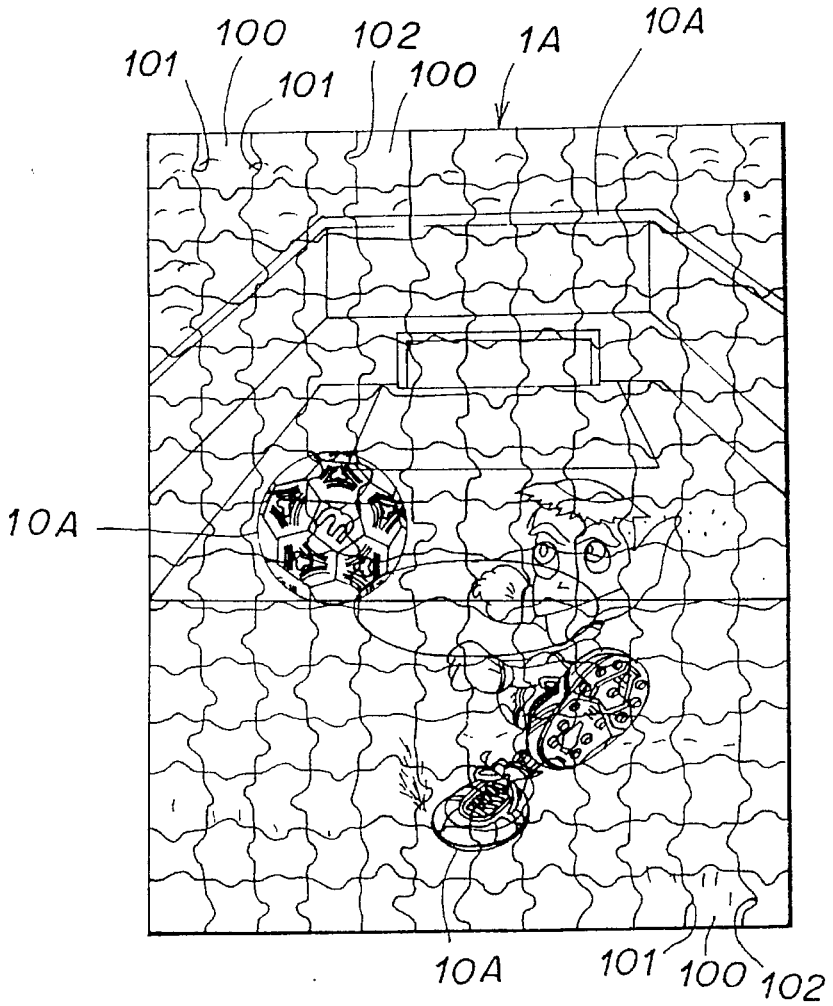
FIG. 8 is a front view of a substrate used in a third embodiment of the jigsaw puzzle according to the present invention.

FIG. 8 is a front view of a substrate used in the third embodiment of the jigsaw puzzle according to the present invention.

The jigsaw puzzle according to this embodiment comprises a substrate 1A having provided thereon a painting, photograph or pattern 10A of a soccer ground, player and ball. The jigsaw puzzle also comprises a transparent member having provided thereon a part or all of the painting, photograph or pattern 10A on the substrate 1A. This transparent member may be the aforementioned transparent member 2 or 200 having a FIG. 20 similar to the soccer player and ball in the painting, photograph or pattern 10A on the substrate 1A.

In this embodiment, the transparent member 2 or 200 is laid on the substrate 1A in such a manner that the soccer player and ball in the painting, photograph or pattern 10A on the substrate 1A are superposed on those on the transparent member 2 or 200.

In a variant of this embodiment, a painting of "Mona Lisa" is provided on the substrate. Only the Mona Lisa is provided on the transparent member (the background is not provided). The Mona Lisa on the transparent member is superposed on the Mona Lisa painting on the substrate.

Figure 9:
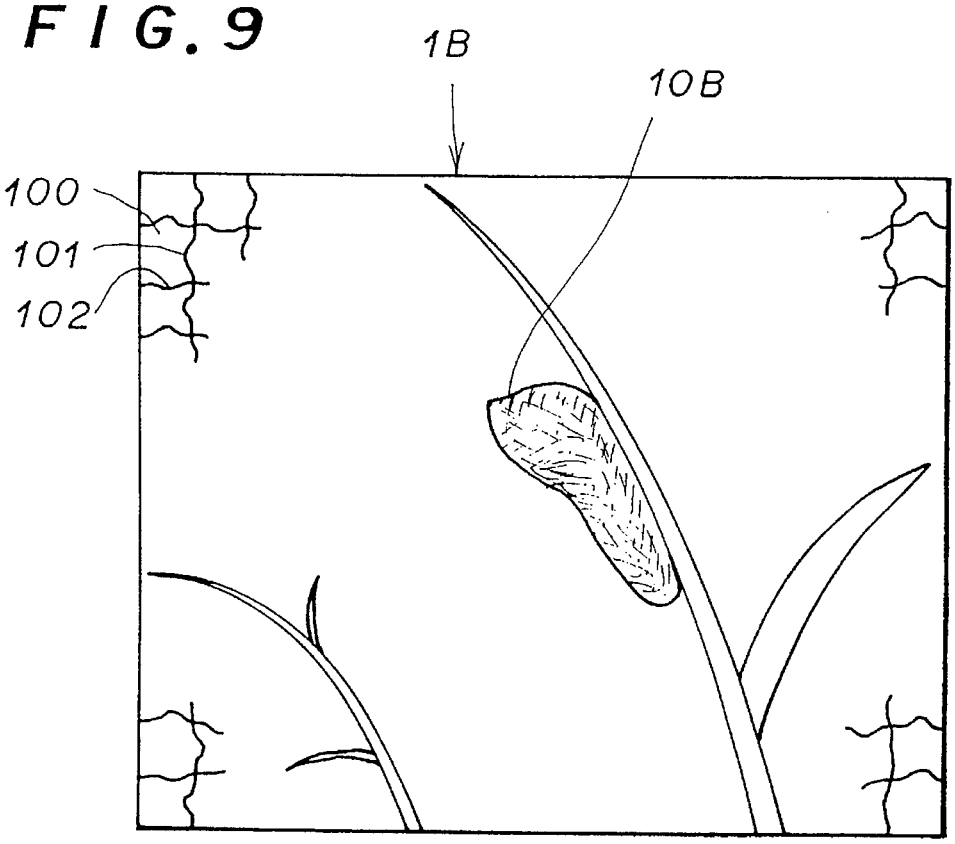
FIG. 9 is a front view of a substrate used in a fourth embodiment of the jigsaw puzzle according to the present invention.
Figure 10:
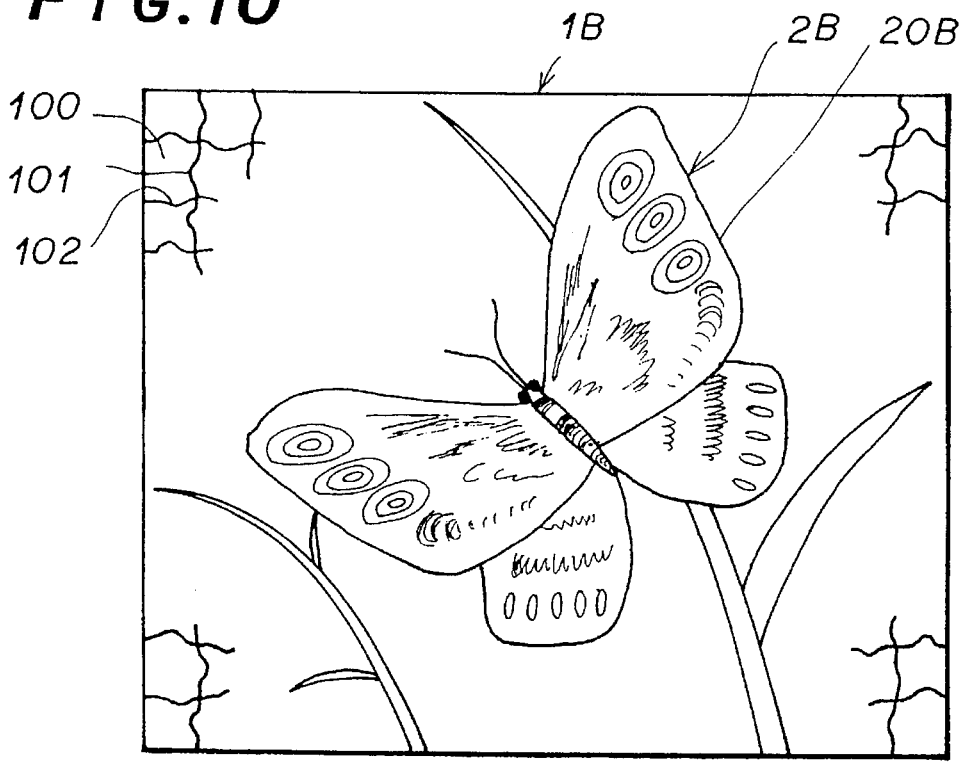
FIG. 10 is a front view of a transparent sheet disposed on the substrate in FIG. 9.

FIGS. 9 and 10 are front views showing the fourth embodiment of the jigsaw puzzle according to the present invention.

The jigsaw puzzle according to this embodiment comprises a substrate 1B having provided thereon a painting, photograph or pattern 10B of a pupa, for example, and a transparent member 2B having a butterfly 20B, for example, marked thereon. When the butterfly 20B on the transparent member 2B is superposed on the painting, photograph or pattern 10B of the pupa on the substrate 1B, the pupa changes to the butterfly.

In a variant of this embodiment, a painting, photograph or pattern of a Cinderella in the shape of a maid, a pumpkin, a witch, etc. is provided on the substrate, while Cinderella in the shape of a princess, carriage, etc. are provided on the transparent member. When the transparent member is laid on the substrate, the Cinderella changes from the shape of a maid to that of a princess.

What is claimed is:

1. A jigsaw puzzle, comprising:

a substrate having first and second sides, and having a painting provided on the first side thereof, and cut into a multiple of irregular and interlocking pieces defined by cutting lines; and a transparent member provided thereon another painting having close relationship with said painting of the substrate, and adapted to be laid on the first side of said substrate in such a manner that a part of said painting of the substrate is concealed by said another painting, thereby said another painting of the transparent member can be seen emphatically in relation to said painting of the substrate with the cutting lines concealed.

2. A jigsaw puzzle as set forth in claim 1, further comprising an intermediate member laid between said substrate and said transparent member.

3. A jigsaw puzzle as set forth in claim 1, further comprising means for holding said substrate and said transparent member.

4. A jigsaw puzzle as set forth in claim 2, further comprising means for holding said substrate, said intermediate member and said transparent member.

5. A jigsaw puzzle as set forth in claim 1, wherein said transparent member is a portion cut from a transparent sheet, carrying said another painting printed thereon.

6. A jigsaw puzzle, comprising:

a substrate having first and second sides, and having a painting provided on the first side thereof, and cut into a multiple of irregular and interlocking pieces defined by cutting lines; and a transparent member having another painting provided thereon which is identical to a part or all of said painting of the substrate, and adapted to be laid on the first side of said substrate with said another painting superposed with said painting of the substrate, thereby said part or all of said painting of the substrate can be seen with the cutting lines defining said multiple pieces concealed by another painting.

7. A jigsaw puzzle as set forth in claim 6, further comprising an intermediate member laid between said substrate and said transparent member.

8. A jigsaw puzzle as set forth in claim 6, further comprising means for holding said substrate and said transparent member.

9. A jigsaw puzzle as set forth in claim 7, further comprising means for holding said substrate, said intermediate member and said transparent member.

10. A jigsaw puzzle as set forth in claim 6, wherein said transparent member is a portion cut from a transparent sheet, carrying said another painting printed thereon.

11. A jigsaw puzzle, comprising:

a substrate having first and second sides, and having a painting provided on the first side thereof, and cut into a multiple of irregular and interlocking pieces; and a transparent member provided thereon another painting having close conceptual relationship with a part of the painting of said substrate, and adapted to be laid on the first side of said substrate for concealment of said part of the painting of said substrate, thereby said another painting can be seen as if said another painting changed from said part of painting of the substrate with cutting lines defining the multiple pieces on which said part of the painting is provided.

12. A jigsaw puzzle as set forth in claim 11, further comprising an intermediate member laid between said substrate and said transparent member.

13. A jigsaw puzzle as set forth in claim 11, further comprising means for holding said substrate and said transparent member.

14. A jigsaw puzzle as set forth in claim 12, further comprising means for holding said substrate, said intermediate member and said transparent member.

15. A jigsaw puzzle as set forth in claim 11, wherein said transparent member is a portion cut from a transparent sheet, carrying said another painting printed thereon.

16. A jigsaw puzzle, comprising:

a substrate having first and second sides, and having a painting provided on the first side thereof, and cut into a multiple of irregular and interlocking pieces defined by cutting lines; and a plurality of transparent sheets each provided thereon a different painting which is identical to a different part of said painting of the substrate and adapted to be laid subsequently on the first side of said substrate, thereby said different parts can be seen with the cutting lines concealed by the different paintings.

* * * * *